United States Patent [19]

Shuster

[11] Patent Number: 4,750,389

[45] Date of Patent: Jun. 14, 1988

[54] STRAP WRENCH

[76] Inventor: Abraham Shuster, 24 Plant St., New Haven, Conn. 06515

[21] Appl. No.: 903,479

[22] Filed: Sep. 4, 1986

[51] Int. Cl.[4] ..... B25B 13/52

[52] U.S. Cl. ..... 81/64; 81/3.43

[58] Field of Search ..... 81/64, 3.43; 7/100; 24/198, 200, 68 D, 68 T

[56] References Cited

U.S. PATENT DOCUMENTS

| | | | |
|---|---|---|---|
| 689,325 | 12/1901 | Sands | 81/64 |
| 1,055,800 | 3/1913 | Rosenkranz | 24/198 |
| 1,525,358 | 2/1925 | Bergen | 81/64 |
| 3,728,916 | 4/1973 | Brantley | 81/64 |
| 4,114,481 | 9/1978 | Kowalczyk | 81/64 |

*Primary Examiner*—Frederick R. Schmidt

*Assistant Examiner*—Bradley I. Vaught

*Attorney, Agent, or Firm*—Costas and Montgomery

[57] ABSTRACT

A strap wrench adapted to fit about an object having a connection to another object, so that the connection may be tightened or loosened, comprising a flexible strap having an end attached to a securing member and a free end which is received in a securing member which provides infinite adjustment of the periphery of the strap and retains the strap at a predetermined size determined by the circumference of the object to be turned, a wrenching member is pivotally connected to the securing member and the wrenching member has a shape defining a corner or projection for bearing on the strap and exerting a force thereon when the wrenching member is rotated by a turning tool inserted therein.

6 Claims, 1 Drawing Sheet

STRAP WRENCH

FIELD OF THE INVENTION

This invention relates to strap wrenches of the type wherein a flexible member is positioned around an object having a connection to another object or body, where it is desired to loosen or tighten the connection between the bodies.

BACKGROUND OF THE INVENTION

Strap wrenches are known in which a chain or flexible strap has one end fixed and another end loose for frictionally engaging an annular body for turning by a levering element, such as the socket of a socket wrench or a socket screwdriver. Known constructions have several disadvantages, particularly in that the strap for mounting about an annular body such as a cylindrical oil filter is not adjustable in circumference.

Strap wrenches which utilize a band of steel having a socket receiving member are well known. However, when a metallic strap is utilized, this does not provide for adjustment of size and does not provide tight gripping on the object. Such a construction is shown in U.S. Pat. No. 4,114,481.

Other types of adjustable strap wrenches have been disclosed in the past. For example, U.S. Pat. No. 4,037,495 discloses a strap wrench which is adjusted in circumference through hook and loop connections.

Flexible strap wrenches adapted to fit around a cylindrical object such as an oil filter, are disclosed in U.S. Pat. Nos. 4,249,296, 2,995,965, and 4,506,568. The strap wrenches disclosed in these patents rely solely on frictional engagement of the strap about the object to be turned. In U.S. Pat. No. 4,506,568, a specially designed levering body is utilized to receive two ends of a strap and supposedly a two-part holder structure prevents any change in the circumference of the strap once the circumference is set. However, the device shown in U.S. Pat. No. 4,506,568, as well as that shown in U.S. Pat. No. 2,995,965, are subject to slippage of the strap in the wrenching member.

The present invention provides a simple and economical strap wrench which may be infinitely adjusted and fixed as to circumference, and which provides increased frictional engagement of the strap wrench with the part to be acted upon and does not disturb the fixed circumference. The construction of the strap wrench is economical and simple and permits the turning of an object of any size in restricted spaces.

SUMMARY OF THE INVENTION

Briefly stated, the invention in one form thereof, comprises a flexible strap member which is adapted to fit about a first object having a connection to another object so that the connection may be tightened or loosened. The flexible strap has a free end pivotally attached to a strap securing member such as a slide buckle, and a free end which is received between the bars in the slide buckle. This provides infinite adjustment of the periphery of the strap. A wrenching member is pivotally connected to the buckle. The direct connection between the end of the strap, which is pivotally connected to the middle of the buckle, and the wrenching member, which is pivotally connected to one of the outside ends of the buckle, retains the strap at a predetermined peripheral size, which may be determined by the circumference of the object to be turned. The direct connection between the strap and wrenching member prevents any disturbing of predetermined peripheral size by increasing the frictional engagement between the strap and the object to be turned. The wrenching member has a socket for receiving a turning tool and a shape defining a corner or projection for bearing on the strap and exerting a force thereon when the wrenching member is rotated by a turning tool inserted therein, so that the corner of the wrenching member may pivot with respect to the buckle due to force exerted by the inserted turning tool, and exert a inwardly directed force on the object to be turned through the strap, and increase the frictional engagement between the strap and the first object.

As the frictional engagement of the strap on the object is increased due to the pressure exerted by the corner of the wrenching member, and with the wrenching member pivotally connected to the buckle, there is no tendency for the strap to slip in the buckle. At this point, the tension in the strap is between the corner of the wrenching member and the end of the strap secured to the buckle. Thus, the set periphery of the strap does not change, and increased frictional contact between the strap and the object to be turned is attained.

An object of this invention is to provide a new and improved strap wrench.

A further object of this invention is to provide a new and improved strap wrench which is simplified in construction and which provides infinite adjustment of the circumference of the strap which is fixed when once set, while providing an increased frictional contact of the strap about the object.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF PREFERRED EMBODIMENT OF THE INVENTION

Figure 1:
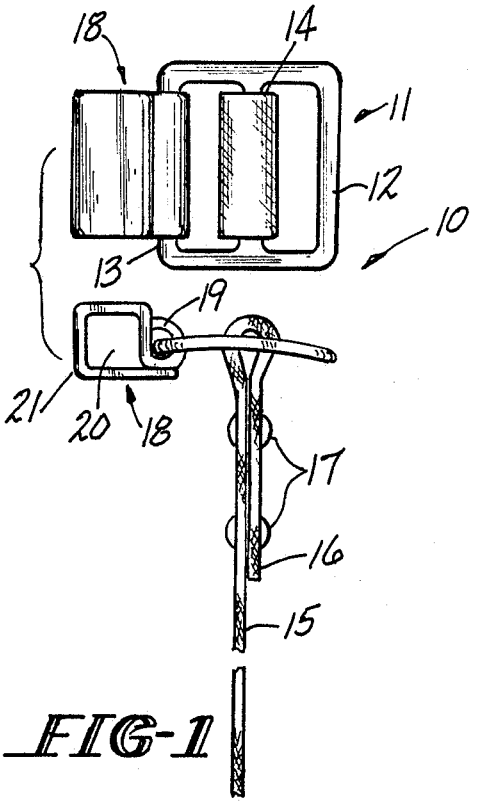
FIG. 1 shows a side elevation of a portion of a strap wrench fastened to a slide buckle and a levering member pivotally attached thereto and also shows a plan view of the same.

As shown in FIG. 1, a device embodying the invention 10 comprises a slide buckle 11 of the type having outside bars 12 and 13 and a intermediate bar 14. A strap 15 is pivotally looped around intermediate bar 14, with an end 16, and then affixed to itself as by means of rivets or other fasteners 17.

Pivotally connected to bar 13 is a levering or wrenching member 18 which is so formed at 19 as to be pivotally connected to bar 13 and to define a socket receiving opening 20 therein. The socket receiving opening 20 is provided to receive the socket of a socket wrench or a socket attachment to a driver. The wrenching member is preferably of polygonal shape and defines at least one corner 21 which is adapted to bear on the engaged strap.

Figure 3:
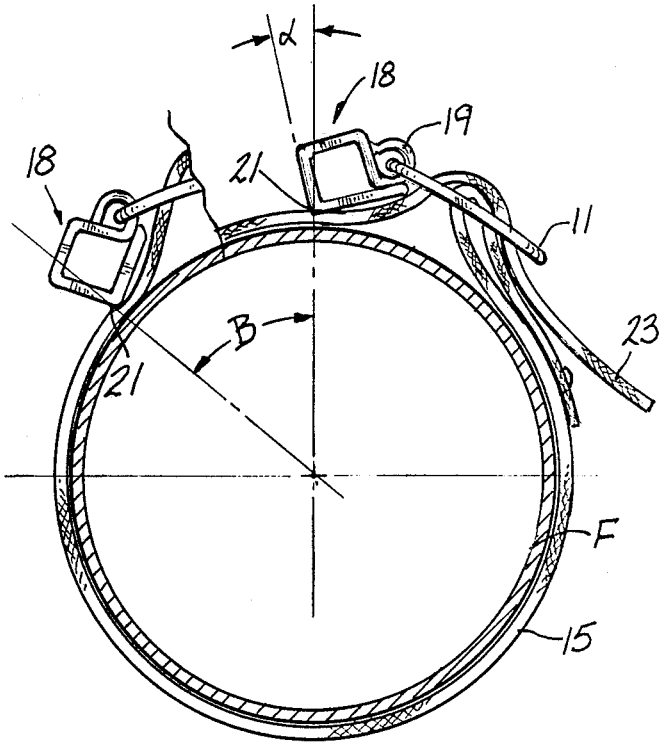
FIG. 3 is a view seen in the plane of lines 3—3 of FIG. 2.
Figure 2:
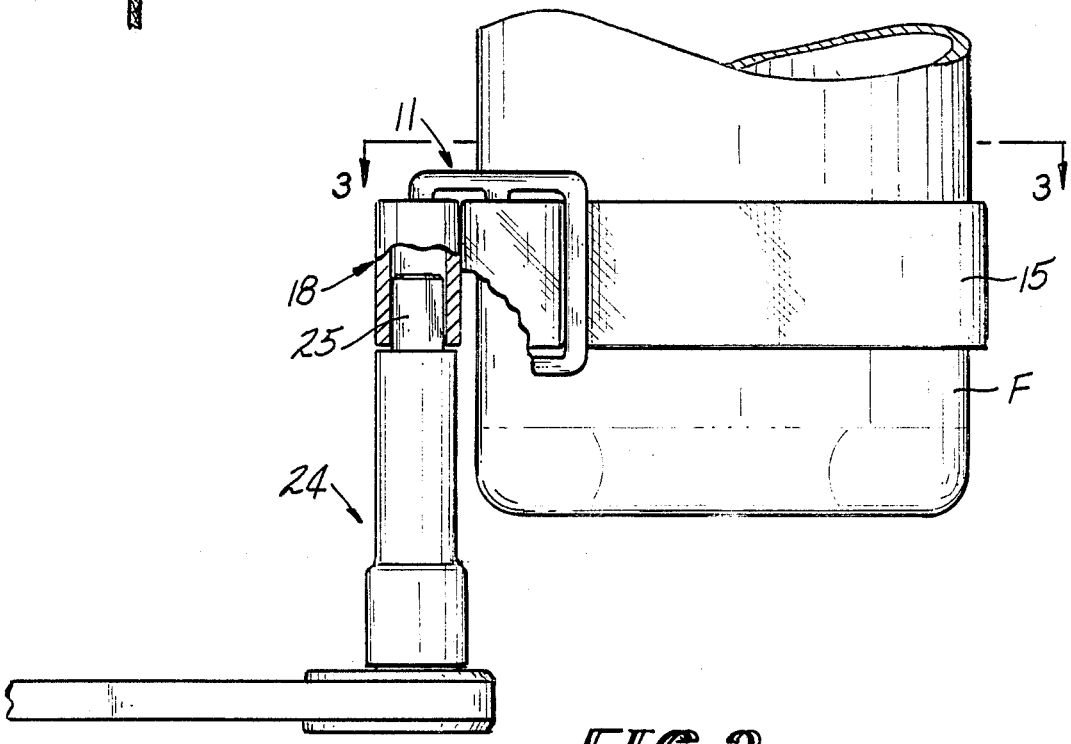
FIG. 2 illustrates a device embodying the invention in an operative position fastened about a cylindrical object.

Reference is now made to FIG. 2 which exemplifies the strap wrench as applied to an oil filter cartridge F, which is of cylindrical peripheral shape. The strap wrench 10 has the free end of the strap 23 as shown in FIG. 3 received through the slide buckle 11. This will retain the circumference of the strap 15 in a predetermined size. In the case of oil filter cartridges, the periphery of the strap wrench may be determined by affixing the strap about the replacement filter and adjusting to size.

As shown in FIG. 2, a socket wrench 24 having a socket 25 is inserted into wrenching or levering member 18, which is pivotally connected to bar 13 of loop 11.

In practice or operation, the free end of the strap 15 is adjusted in the buckle 11 to a size which will fit an oil filter or other object to be turned, and then slipped over the object. The buckled connection will maintain the strap in a set circumference.

Then the socket member 25 is inserted into the socket 20 and the wrenching member 18 is rotated through an angle Alpha ($\alpha$), as shown in FIG. 3. This causes the edge 21 of the levering member to rotate inwardly against the strap 15, and increase the frictional contact between member 18 and strap 15 and transfer this generally radially directed force to the member F. As the socket member is further rotated, the member 18, as shown, moves through the angle Beta ($\beta$) with the edge 21 exerting increased force on the strap 15 and the object F to increase frictional contact of the strap 15 on the object F and thereby produce turning of the member F, dependent on which direction the strap has bee inserted onto the object.

This insures that the strap 15 will not slip on the object F as a turning torque is produced on the levering member 18 and as the corner 21 tightly engages the strap 15.

At this time, the contact of corner 21 on strap 15 prevents any slippage of the strap on object F, and there is, in essence, a direct connection between the point of contact of wrenching member 18, pivotally connected to bar 13, and the end of the strap 15, pivotally connected about intermediate bar 14. This direct connection does not disturb the fixed adjustment of the strap in the buckle when the frictional engagement between the strap and the object F is increased. The connection of the strap to the buckle bar 14 and the pivotal connection of wrenching member 18 to buckle bar 13 becomes a direct connection which prevents any slippage of the free end of the belt in the buckle.

The form of the buckle 11 is not important so long as it will maintain a predetermined circumference of the strap and provide the direct connection described.

When it is desired to remove or apply an object F, the strap 15 is first fitted thereto to obtain the desired circumference and it is applied to the object F in a direction correlated to the direction of torque to be applied to the object F. Then a socket member, such as a wrench or socket headed driver is inserted into the opening 20 of member 18 and turned so that the tangential surface friction between the strap 15 and the member F is greatly increased due to the force applied by edge 21 as member 18 is rotated to tension the strap about the member F.

This arrangement facilitates the removal of hard-to-reach objects such as oil filters. Further, through the provision of the wrenching member 18, the socket wrench or socket driver may utilize extensions so that the force applying device does not have to reside substantially close to the strap.

The socket receiving member has been illustrated as a sheet formed in four sided polygonal form with a hinge portion 19 pivotal about bar 13 of slide buckle 11. However, it is to be understood that the socket receiving member may take any form so long as a projection such as corner 21 is defined thereon and it is pivotally attached to the strap securing member. The strap wrench has been described using a slide buckle, however any type of buckling device which will permit the inner periphery of the strap to be infinitely adjusted may be used.

It may thus be seen that the objects of the invention set forth, as well as those made apparent from the foregoing description, are efficiently attained. While a preferred embodiment of the invention has been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiment which do not depart from the spirit and scope of the invention.

Having thus disclosed the invention, what is claimed is:

1. A strap wrench adapted to fit about a first object having a rotatable connection to another object, so that the object may be turned and the connection may be tightened or loosened, comprising a flexible strap having a free end and an opposite end, a securing member, said opposite end being pivotally attached to said securing member, said securing member defining an opening receiving said free end of said strap and providing infinite and fixed adjustment of the size of a loop defined by said flexible strap and said securing member, said securing member retaining said strap free end at a predetermined fixed loop size determined by the circumference of said first object, a wrenching member freely pivotally connected to said securing member and thereby being directly connected to the said opposite end of said strap, said wrenching member having means defined thereon for engaging a turning tool, said wrenching member having a shape defining a portion for bearing on said strap and exerting a force thereon when said wrenching member is rotated by a turning tool, whereby said portion of said wrenching member may pivot with an engaged turning tool and exert a radially inwardly directed force on said first object to be turned by said strap while simultaneously through said direct connection tension said loop and increase the frictional engagement and the resulting tangential force applied by said loop to said first object, thereby utilizing the tangential force applied by the direct connection of said strap between its pivotal connection to said securing member and said wrenching member together with said radially directed force to turn said first object relative to said other object.

2. The strap wrench of claim 1 where the said means on said wrenching member for engaging a turning tool is an opening defined in said wrenching member forming a socket for receiving a turning tool.

3. The strap wrench of claim 1 where said securing member is a buckle having three spaced apart substantially parallel bars and said opposite end of said strap is affixed to the middle bar.

4. The strap wrench of claim 3 where said wrenching member is pivotally connected to one of the outer bars of said buckle.

5. The strap wrench of claim 1, where said wrenching member is polygonal in shape, and said means defined thereon for engaging a turning tool is a socket configured to receive a socket driver.

6. The strap wrench of claim 4 where said wrenching member is essentially four sided.

* * * * *